US012752209B2

(12) United States Patent
Sakai

(10) Patent No.: US 12,752,209 B2
(45) Date of Patent: Oct. 6, 2026

(54) CREATION TABLE FOR FUSIBLE TOY BEAD

(71) Applicant: EPOCH COMPANY, LTD., Tokyo (JP)

(72) Inventor: Ryo Sakai, Tokyo (JP)

(73) Assignee: EPOCH COMPANY, LTD., Tokyo (JP)

( * ) Notice: Subject to any disclaimer, the term of this patent is extended or adjusted under 35 U.S.C. 154(b) by 156 days.

(21) Appl. No.: 18/413,874

(22) Filed: Jan. 16, 2024

(65) Prior Publication Data

US 2024/0238690 A1 Jul. 18, 2024

(30) Foreign Application Priority Data

Jan. 17, 2023 (JP) ..... 2023-005138

(51) Int. Cl.
*A63H 33/08* (2006.01)
*A63H 33/14* (2006.01)

(52) U.S. Cl.
CPC ..... *A63H 33/086* (2013.01); *A63H 33/14* (2013.01)

(58) Field of Classification Search
CPC ..... A63H 33/06; A63H 33/001; A63H 33/08
See application file for complete search history.

(56) References Cited

U.S. PATENT DOCUMENTS 1,678,966 A * 7/1928 Whiting ..... B44C 3/12 269/40
3,530,615 A * 9/1970 Meyer ..... A63F 9/06 40/437
3,975,023 A * 8/1976 Inamori ..... A63B 60/00 473/329
4,573,685 A * 3/1986 Young, IV ..... A63B 60/00 473/250
4,798,292 A * 1/1989 Hauze ..... A61L 2/26 206/439
4,986,756 A * 1/1991 Yamaguchi ..... A63F 9/06 434/96
5,176,521 A * 1/1993 McRae ..... G09B 1/10 434/200

(Continued)

FOREIGN PATENT DOCUMENTS

JP 2015-181915 A 10/2015
JP 2018-191839 A 12/2018
JP 7068738 B1 5/2022

OTHER PUBLICATIONS

Great Britian Office Action issued Jun. 20, 2024 in Application No. 2400607.4.

(Continued)

*Primary Examiner* — Michael D Dennis
*Assistant Examiner* — Matthew B Stanczak
(74) *Attorney, Agent, or Firm* — Faegre Drinker Biddle & Reath LLP

(57) ABSTRACT

A creation table for fusible toy bead, includes a first table having a plurality of through holes and a second table including a plurality of pins. The first table is configured to allow a fusible toy bead to be placed on a first direction side of the plurality of through holes. The plurality of pins is allowed to be inserted into and removed from a second direction side of the plurality of through holes, respectively. The second direction side is opposite to the first direction side.

3 Claims, 6 Drawing Sheets

(56) References Cited

U.S. PATENT DOCUMENTS 5,348,302 A * 9/1994 Sasamoto ..... A63B 53/047 273/DIG. 23
5,391,105 A * 2/1995 Jones ..... A63H 33/22 446/485
5,672,120 A * 9/1997 Ramirez ..... A63B 53/047 473/347
5,704,789 A * 1/1998 Yang ..... G09B 11/00 434/96
6,860,784 B2 * 3/2005 Chernov ..... G09B 25/00 40/427
7,390,237 B2 * 6/2008 Lin ..... A63F 9/1044 273/287
7,654,021 B2 * 2/2010 Kleyman ..... G01B 5/207 33/561.1
7,654,023 B2 * 2/2010 Peters ..... G09F 9/305 40/564
8,349,279 B2 * 1/2013 Taike ..... B01L 3/50855 422/561
8,827,711 B2 * 9/2014 Davis ..... B65D 1/34 434/96
9,320,330 B2 * 4/2016 Cooke ..... A63F 9/06
9,849,718 B1 * 12/2017 Garrett ..... A44C 27/00
10,328,356 B1 * 6/2019 Harper ..... B44C 1/28
10,398,951 B2 * 9/2019 Golden ..... B21K 17/00
10,478,740 B2 * 11/2019 Sakai ..... A63H 33/001
D891,513 S * 7/2020 Sakai ..... D19/111
D891,516 S * 7/2020 Sakai ..... D19/111
D922,485 S * 6/2021 Sakai ..... D19/111
D923,090 S * 6/2021 Sakai ..... D19/111
D987,721 S * 5/2023 Sakai ..... D19/111
D997,559 S * 9/2023 Sakai ..... D3/304
D1,016,490 S * 3/2024 Sakai ..... D3/304
12,046,160 B1 * 7/2024 Antonio, Jr. ..... G06F 1/1626
12,311,282 B2 * 5/2025 Robbins ..... A63H 33/14
12,594,508 B2 * 4/2026 Sakai ..... A63H 33/001
2002/0102905 A1 * 8/2002 Tseng ..... A63H 33/046 446/131
2005/0178693 A1 * 8/2005 Gupta ..... D03D 29/00 206/574
2005/0227573 A1 * 10/2005 Lin ..... A63F 9/1044 446/85
2006/0225327 A1 * 10/2006 Peters ..... G09F 9/305 40/547
2007/0017885 A1 * 1/2007 Taike ..... B01L 3/50855 211/85.13
2008/0058117 A1 * 3/2008 Roach ..... A63B 53/047 473/332
2010/0212197 A1 * 8/2010 Kleyman ..... F02F 1/102 33/561.1
2011/0073519 A1 * 3/2011 Davis, II ..... B65D 1/34 206/562
2014/0120501 A1 * 5/2014 Cooke ..... B44C 3/123 434/81
2016/0354705 A1 * 12/2016 Poulus ..... A63H 33/04
2017/0087480 A1 * 3/2017 Poulus ..... A63H 33/086
2017/0095046 A1 * 4/2017 Lobortas ..... B23P 5/00
2017/0246551 A1 * 8/2017 Kamiyama ..... A63H 33/001
2018/0036647 A1 * 2/2018 Sakai ..... A63H 33/04
2018/0043276 A1 * 2/2018 Sakai ..... A63H 33/14
2018/0333653 A1 * 11/2018 Sakai ..... A63H 33/06
2019/0192961 A1 * 6/2019 Sakai ..... B44B 9/00
2019/0255454 A1 * 8/2019 Arias ..... B29C 43/021
2019/0329144 A1 * 10/2019 Sakai ..... B44C 3/12
2019/0336880 A1 * 11/2019 Sakai ..... A63H 33/00
2020/0294416 A1 * 9/2020 Roh ..... G09B 7/00
2021/0283522 A1 * 9/2021 Sakai ..... A63H 33/14
2023/0234067 A1 7/2023 Moro et al.
2023/0330555 A1 * 10/2023 Jun ..... A63H 33/086
2024/0024795 A1 * 1/2024 Li ..... A63H 33/001
2024/0238687 A1 * 7/2024 Sakai ..... A63H 33/00
2024/0238690 A1 * 7/2024 Sakai ..... A63H 33/086
2024/0367068 A1 * 11/2024 Sakai ..... A63H 33/001
2024/0367070 A1 * 11/2024 Sakai ..... A63H 33/001
2024/0408507 A1 * 12/2024 Thijs ..... A63H 33/065
2025/0144540 A1 * 5/2025 Sakai ..... A63H 33/14
2026/0115615 A1 * 4/2026 Sakai ..... A63H 33/04
2026/0115618 A1 * 4/2026 Osnato ..... A63H 33/06

OTHER PUBLICATIONS

Korean Office Action issued Jun. 18, 2025, in Application No. 10-2024-0007169.
Spanish State of the Art Report issued Dec. 20, 2024 in Application No. P202430035.
French Search Report issued Jul. 10, 2025 in Application No. 2400426.

* cited by examiner

CREATION TABLE FOR FUSIBLE TOY BEAD

CROSS-REFERENCE TO RELATED APPLICATIONS

This application is based on and claims priority under 35 USC 119 from Japanese Patent Application No. 2023-005138 filed on Jan. 17, 2023, the contents of which are incorporated herein by reference.

TECHNICAL FIELD

The present disclosure relates to a creation table for fusible toy bead.

BACKGROUND ART

A creation table for fusible toy bead allowing an assembly of fusible toy beads placed on the creation table for fusible toy bead to be removed before completely dried out so as to create a next assembly of fusible toy beads is disclosed in the related art. For example, JP2018-191839A discloses a creation table for fusible toy bead including a table on which fusible toy beads are arranged, and a receiver to be inverted together with the table and including a receiving surface that is receives, moves, and dries the arranged fusible toy beads.

SUMMARY OF INVENTION

In the creation table for fusible toy bead disclosed in JP2018-191839A, since the table and the receiver are inverted together, it is necessary to arrange the table and receiver side by side, which requires a large space.

An object of the present disclosure is to provide a creation table for fusible toy bead which can be used even in a narrow space.

In an aspect of the present disclosure, there is provided a creation table for fusible toy bead, including: a first table having a plurality of through holes, the first table being configured to allow a fusible toy bead to be placed on a first direction side of the plurality of through holes; and a second table including a plurality of pins, the plurality of pins being allowed to be inserted into and removed from a second direction side of the plurality of through holes, respectively, the second direction side being opposite to the first direction side.

According to the present disclosure, it is possible to provide a creation table for fusible toy bead which can be used even in a narrow space.

BRIEF DESCRIPTION OF DRAWINGS

The present disclosure will be described in detail based on the following without being limited thereto, wherein:

The present disclosure will be described in detail based on the following without being limited thereto, wherein:

FIG. 5 is a sectional view corresponding to a cross section taken along the line IV-IV in FIG. 1 in a state where the first table of the creation table for fusible toy bead according to the embodiment of the present disclosure is pushed in.

DESCRIPTION OF EMBODIMENTS

Figure 1:
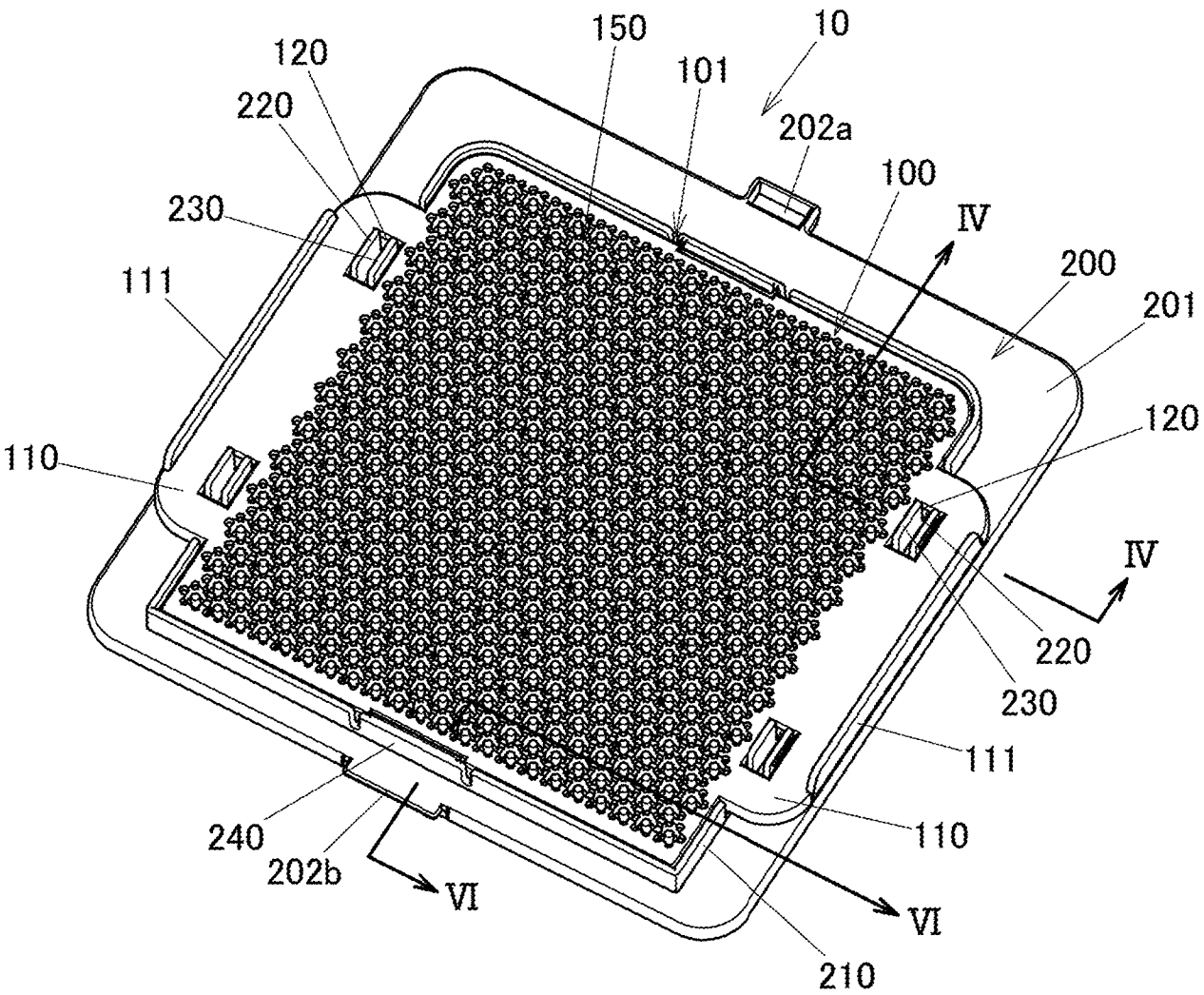
FIG. 1 is a perspective view of a creation table for fusible toy bead according to an embodiment of the present disclosure.

An embodiment of the present disclosure will be described with reference to the drawings. As shown in FIG. 1, a creation table for fusible toy bead (hereinafter simply referred to as a "creation table") 10 includes a first table 100 and a second table 200. The first table 100 and the second table 200 are formed into plate shapes by injection molding of a resin material. Accordingly, the entire creation table 10 is also formed in a plate shape. The creation table 10 according to the present embodiment is formed in a substantially regular square shape, but may have various shapes. In the following description, a side where the first table 100 is provided will be referred to as an upper side, and a side where the second table 200 is provided will be referred to as a lower side.

A plurality of fusible toy beads 5 (see FIG. 4) can be placed on an upper surface of the first table 100. The creation table 10 is a toy that is played by arranging the plurality of fusible toy beads 5 in accordance with various patterns or the like and combining the fusible toy beads 5 to each other by spraying water with a sprayer or the like.

For example, a paper holder 205 (see FIG. 4) is provided on a lower surface of the second table 200, and can hold a paper on which a pattern or the like is written. The first table 100 and the second table 200 are formed of a transparent material. Accordingly, a user can place the fusible toy beads 5 following a pattern of the paper held in the paper holder 205 and on which the pattern or the like is written.

Here, the fusible toy bead 5 is formed of a water-soluble resin. Specifically, the water-soluble resin is formed by blending polyvinyl alcohol with a resin and kneading the mixture. The resin forming the fusible toy bead 5 may be formed by appropriately selecting a transparent material, a translucent material, or an opaque material. Further, the fusible toy bead 5 may be of various shapes such as spherical or polyhedral.

Figure 2:
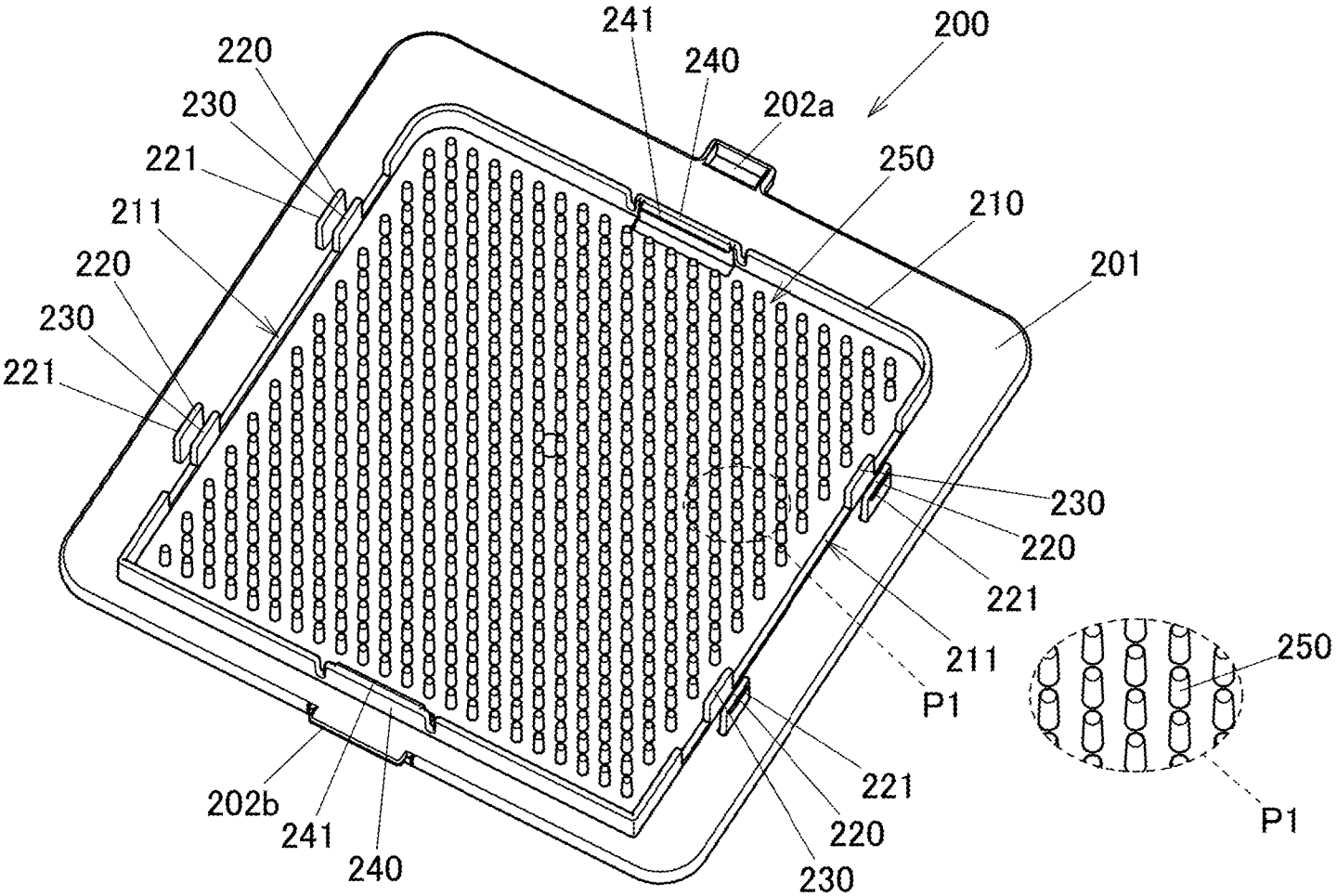
FIG. 2 is a perspective view of a second table of the creation table for fusible toy bead according to the embodiment of the present disclosure.

As shown in FIG. 2, the second table 200 includes a second table base plate 201 in a shape of a substantially rectangular plate with rounded corners. The second table base plate 201 has a wall portion 210 formed in a substantially rectangular annular wall shape with rounded corners. A low wall portion 211 having a lower wall height is formed on one pair of opposing sides of the wall portion 210, respectively. Each low wall portion 211 is provided with plate guides 230 along the low wall portion 211.

Two plate guides 230 are provided on each of the two low wall portions 211 at a predetermined interval along the low wall portion 211, for a total of four plate guides 230. A plate thickness of the plate guide 230 is substantially the same as a thickness of the low wall portion 211 (that is, a plate thickness of the wall portion 210). The plate guide 230 is disposed such that at least a surface on an inner side (inside of the annular wall portion 210) thereof is continuous with a surface on an inner side of the low wall portion 211 (the wall portion 210). A surface on an outer side of the plate guide 230 is also continuous with a surface on an outer side of the low wall portion 211.

Figure 4:
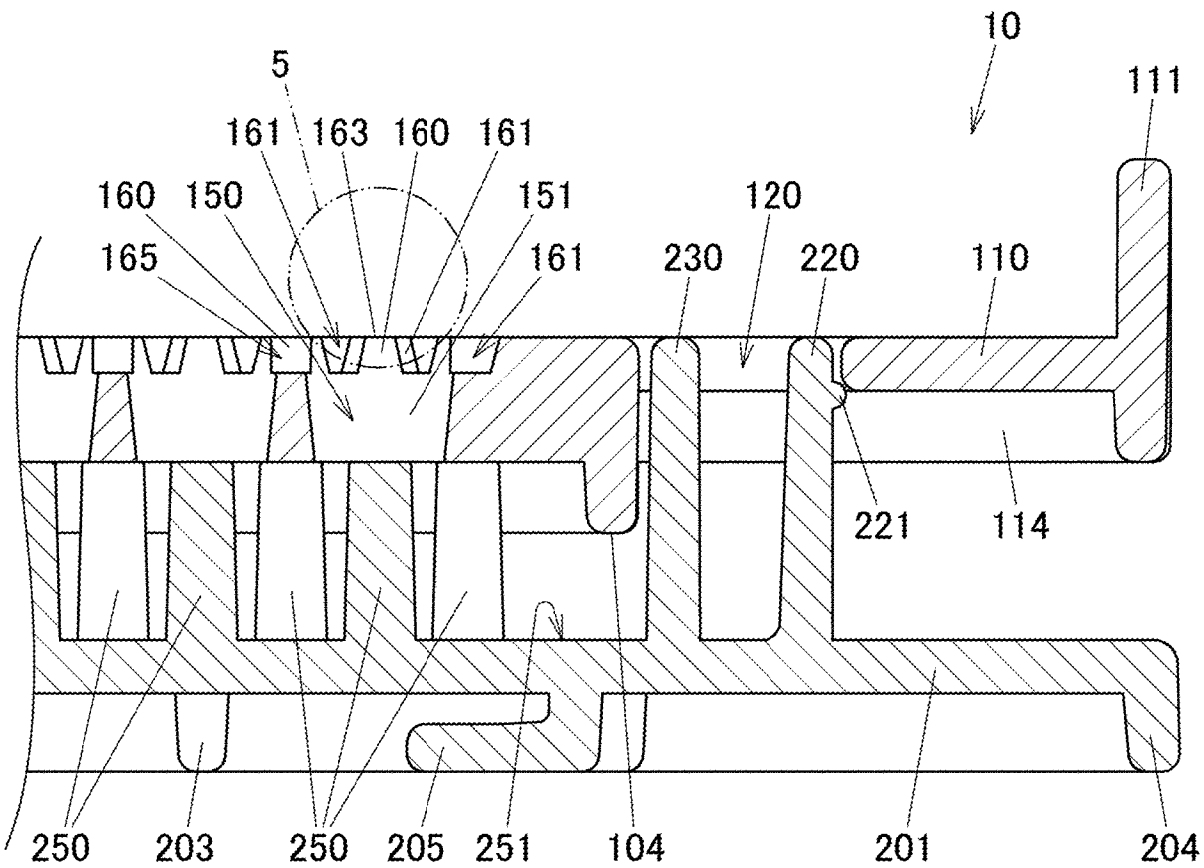
FIG. 4 is a sectional view of the creation table for fusible toy bead according to the embodiment of the present disclosure taken along a line IV-IV in FIG. 1.

A guide plate spring 220 is provided on an outer side (outside of the annular wall portion 210) of each plate guide 230 at a predetermined distance from the plate guide 230. The guide plate spring 220 is provided parallel to the plate guide 230, and is formed in a plate shape having a width substantially the same as the plate guide 230. As shown in FIG. 4, the guide plate spring 220 is formed in a tapered shape whose plate thickness is gradually reduced from a base end toward the upper side, and has a spring property. The guide plate spring 220 is provided with an engagement protrusion 221 having a length substantially the same as the width of the guide plate spring 220 at an upper portion of a surface on the outer side.

Returning to FIG. 2, a regulating plate spring 240 that is formed by notching the wall portion 210 at two places to have a spring property is provided on each of the other pair of two sides (sides of the wall portion 210 where the low wall portion 211 is not provided) of the wall portion 210. A regulating protrusion 241 that protrudes inward in a hook shape is formed on the regulating plate spring 240 provided on the wall portion 210. The regulating protrusion 241 is formed to have a length the same as the width of the regulating plate spring 240 and have a hook shape in cross section, and has a regulating surface 241*a* (see FIG. 6) formed on the lower side.

As also shown in the enlarged view of a portion P1 in FIG. 2, a plurality of pins 250 are provided inside the wall portion 210 and stand up from an upper surface of the second table base plate 201. The plurality of pins 250 are provided so that adjacent rows and columns are offset from each other. The pin 250 is formed in a substantially conical shape (tapered pin shape) whose upper side is reduced in diameter. Further, protruding plates 202*a* and 202*b* protruding from an outer edge of the second table base plate 201 are respectively provided outside the regulating plate springs 240. One protruding plate 202*a* has a substantially rectangular shape in which a concave portion is formed. The other protruding plate 202*b* slightly protrudes from the edge of the second table base plate 201. The protruding plates 202*a* and 202*b* are used to attach the creation table 10 to a case for fusible toy bead (not shown) or the like by engaging with the case or the like.

Figure 6:
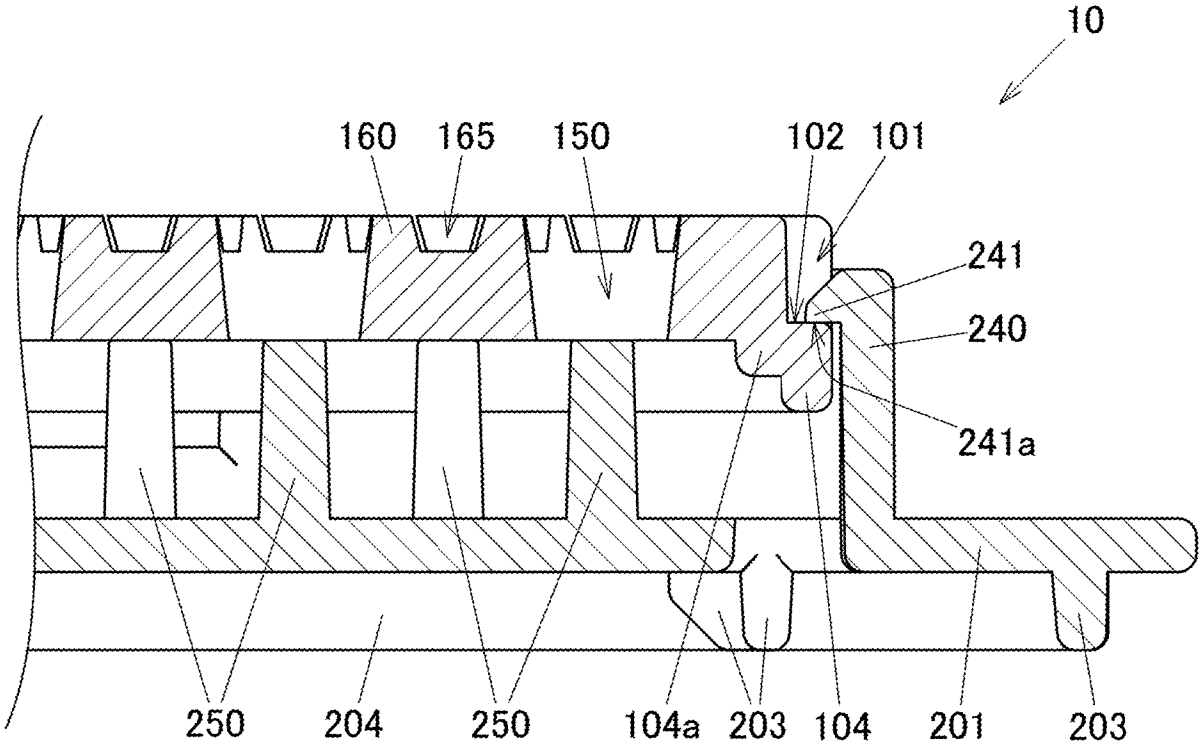
FIG. 6 is a sectional view of the creation table for fusible toy bead according to the embodiment of the present disclosure taken along a line VI-VI in FIG. 1.

As shown in FIG. 6, a plurality of ribs 203 and an edge wall 204 annularly formed along an outer peripheral edge are provided on the lower surface of the second table 200. The paper holders 205 described above are provided on a lower surface of the second table base plate 201 substantially corresponding to the four guide plate springs 220 and the four plate guides 230.

Figure 3:
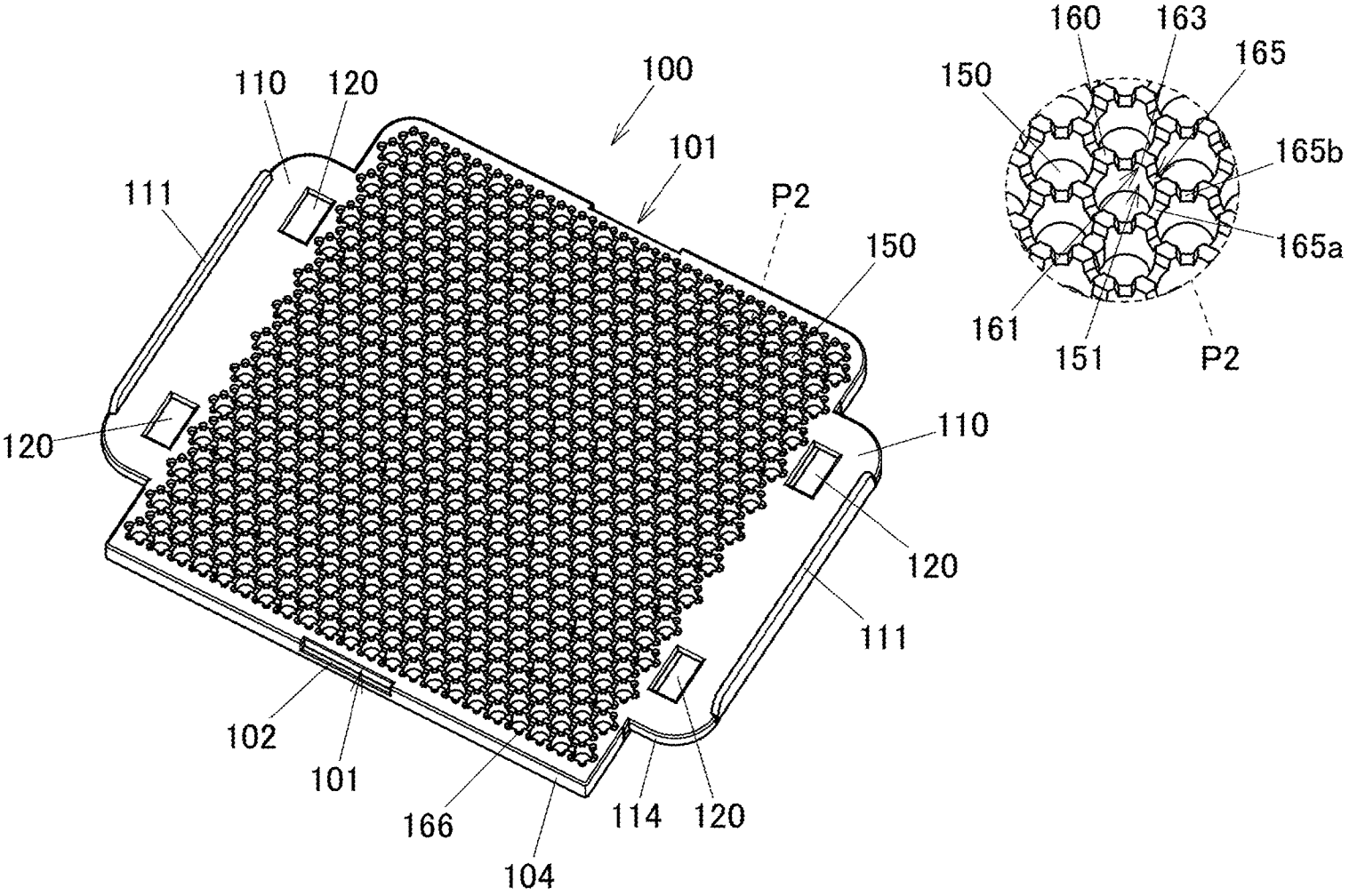
FIG. 3 is a perspective view of a first table of the creation table for fusible toy bead according to the embodiment of the present disclosure.

As shown in FIG. 3, the first table 100 is formed in a substantially rectangular plate shape with rounded corners. Guide bases 110 formed in a plate shape and protruding outward are provided to face other in the first table 100. The guide base 110 is formed into a substantially long rectangular shape with rounded corners along the first table 100. The guide base 110 is provided with two guide holes 120 that are substantially rectangular through holes extending in a longitudinal direction of the guide base 110 and spaced apart from each other by a predetermined distance in the longitudinal direction of the guide base 110. A long protrusion 111 that is long in the longitudinal direction of the guide base 110 and extends upward in a wall shape is provided on an outer edge portion of the guide base 110.

An edge wall 104 having a wall shape and extending downward is formed on a lower surface of the first table 100 along an outer shape (substantially rectangular outer shape) of the first table 100 excluding the guide bases 110. An edge wall 114 having a wall shape and extending downward is formed on a lower surface of the guide base 110 along an outer shape of the guide base 110. An outer surface of the long protrusion 111 is continuous with an outer peripheral surface of the edge wall 114 of the guide base 110.

Concave portions 101 are provided facing each other along an outer peripheral edge of the first table 100 on the outer peripheral edge of the first table 100 on sides where the guide base 110 is not provided. A step portion 102 having a flat upper surface is formed in the concave portion 101. As shown in FIG. 6, a protruding portion 104*a* is formed and built up on the edge wall 104 at a portion corresponding to the concave portion 101.

An upward movement of the first table 100 is restricted by the step portion 102 and the regulating surface 241*a* of the regulating protrusion 241 coming into contact with each other. The first table 100 and the second table 200 can be separated by tilting the regulating plate spring 240 provided with the regulating protrusion 241 outward against a spring force. The regulating protrusion 241 is formed in a tapered shape on the upper side. Accordingly, when the first table 100 is pushed in, the regulating plate spring 240 is opened outward, and the first table 100 and the second table 200 can be combined again.

As shown in FIG. 3 and the enlarged view of a portion P2 in FIG. 3, a plurality of circular through holes 150 are provided in the first table 100. The plurality of through holes 150 are provided so that adjacent rows and columns are offset from each other. As shown in FIG. 4, the through hole 150 is a substantially truncated conical hole whose lower side is reduced in diameter. A plurality of columnar portions 160 each having a hole side surface 161 that is a surface continuous with an inner peripheral surface 151 of the through hole 150 and a groove portion 165 formed between adjacent columnar portions 160 are formed on the upper side that is a first direction side of the through hole 150. The through holes 150 are connected to adjacent through holes 150 by a plurality of groove portions 165.

In other words, the columnar portions 160 are formed by providing a plate member with the through holes 150 so that adjacent rows and columns are offset, and by providing groove portions 165 so as to connect the adjacent through holes 150. At this time, a width of a groove portion 165*a* connecting the through holes 150 adjacent to each other in a direction parallel to the longitudinal direction of the concave portion 101 is wider than a width of a groove portion 165*b* connecting the through holes 150 adjacent to each other in an oblique direction.

Except for the through holes 150 in the outer rows and columns, six columnar portions 160 are provided on an outer periphery of the through hole 150 on the first direction side. A diameter formed by the six columnar portions 160 around the through hole 150 (that is, a diameter of an upper opening edge of the through hole 150) is smaller than a diameter of the fusible toy bead 5. Accordingly, as shown in FIG. 4, the upper opening edge, which is the first direction side of the through hole 150, is formed such that the fusible toy bead 5 can be placed.

The fusible toy bead 5 is supported so as to be in line contact with a corner portion 163 of the columnar portion 160 on the through hole 150 side. That is, the fusible toy bead 5 is supported not in a continuous annular shape but in line contact with intermittent annular shapes by the corner portions 163. Accordingly, the melted fusible toy bead 5 is made difficult to stick to the opening edge of the through hole 150.

In the through holes 150 in the outer rows and columns, a plurality of groove portions 166 are formed in a direction in which no adjacent through holes 150 exist. Accordingly, even in the through holes 150 in the outer rows and columns, the fusible toy beads 5 are supported by the upper opening edges of the through holes 150 in intermittent annular line contact.

As shown in FIG. 1, the first table 100 and the second table 200 can be combined by inserting the guide plate spring 220 and the plate guide 230 into the guide hole 120. The opening edge of the guide hole 120 is guided by being close to or in contact with an inner side surface of the plate guide 230 and an outer side surface of the guide plate spring 220. In other words, a guide part including the guide hole 120, the guide plate spring 220, and the plate guide 230 guides the first table 100 and the second table 200 in an upper-lower direction so that the first table 100 and the second table 200 can approach and separate from each other. Each through hole 150 and each pin 250 are concentric, and the pin 250 can be inserted into and removed from the through hole 150.

A length of the guide base 110 in the longitudinal direction is formed to be slightly shorter than a length of the low wall portion 211. Therefore, an outer periphery of the guide base 110 makes sliding contact with the wall portion 210 at an end portion of the low wall portion 211, which also causes the first table 100 to be guided in the upper-lower direction with respect to the second table 200. An outer peripheral surface of the first table 100 other than the guide base 110 is in close or sliding contact with an inner side surface of the wall portion 210. That is, the guide part that guides the first table 100 and the second table 200 such that the first table 100 and the second table 200 can approach and separate from each other includes the outer periphery of the guide base 110 and the end portion of the low wall portion 211, and includes the outer peripheral surface of the first table 100 other than the guide base 110 and the inner side surface of the wall portion 210.

As shown in FIG. 6, the upward movement of the first table 100 is restricted by the step portion 102 and the regulating surface 241*a* of the regulating protrusion 241 coming into contact with each other. In the first table 100, the guide hole 120 is located above the engagement protrusion 221 of the guide plate spring 220 near a position where the step portion 102 and the regulating surface 241*a* are in contact with each other as shown in FIG. 4. In this state, edge portions of the engagement protrusion 221 and the guide hole 120 come into contact with each other, so that a state in which the first table 100 and the second table 200 are separated (state in FIG. 4) is maintained. In other words, a state in which a lower end of the edge wall 104 and a base end surface 251 of the pin 250, which is the upper surface of the second table base plate 201, are spaced apart from each other by a predetermined distance, or a state where the pin 250 is released from the through hole 150 is maintained.

A method for making an assembly of the fusible toy beads 5 is as follows. In the state shown in FIG. 4, a user places the plurality of fusible toy beads 5 in any through holes 150 of the first table 100. At this time, a tip end of the pin 250 and the fusible toy bead 5 are not in contact with each other and are separated from each other. After the plurality of fusible toy beads 5 are placed, water is sprayed onto the fusible toy beads 5 with a sprayer or the like. The water sprayed onto the first table 100 is stored inside the wall portion 210 of the second table 200 through the groove portion 165 and the through hole 150, and hardly falls outside from a surface of the first table 100.

Next, when the first table 100 is pushed toward the second table 200 by pressing the long protrusion 111 with both hands from the state shown in FIG. 4, the first table 100 and the second table 200 approach each other. At this time, the guide plate spring 220 springs and warps toward the plate guide 230 at an edge of the guide hole 120 that comes into contact with the engagement protrusion 221. Then, the guide hole 120 can pass over the engagement protrusion 221.

Figure 5:
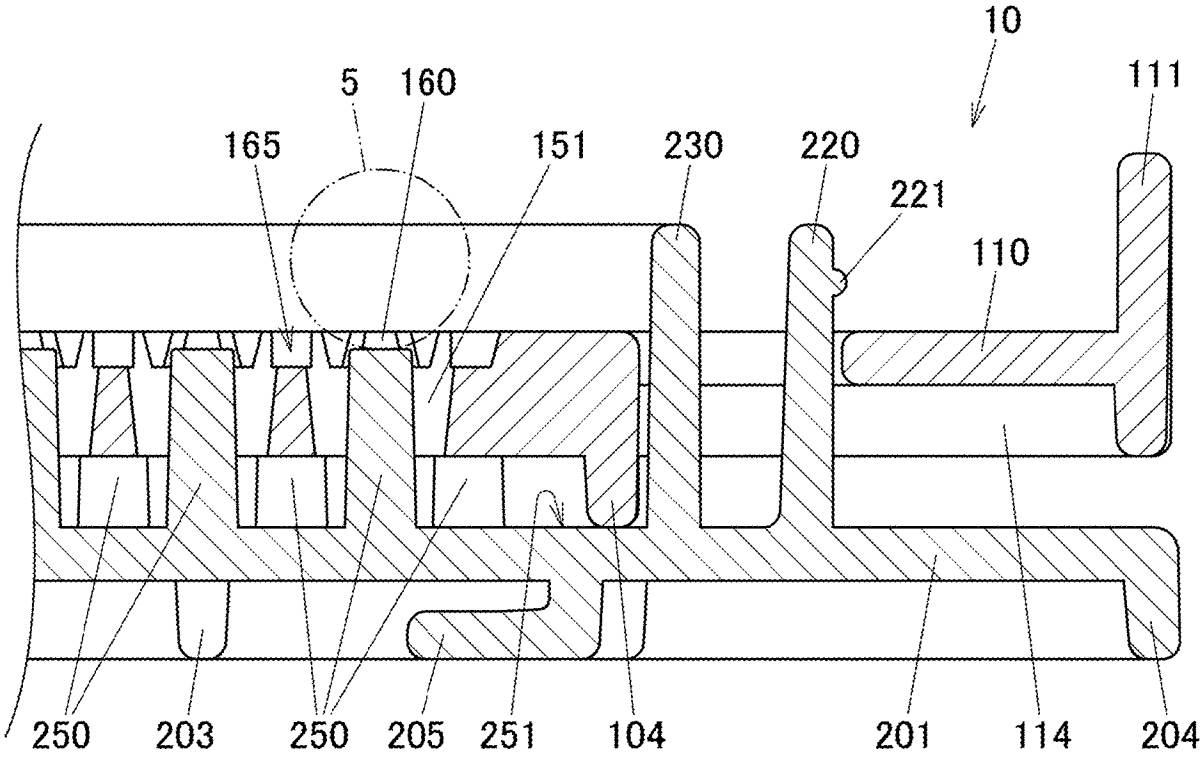

When the guide hole 120 passes over the engagement protrusion 221, as shown in FIG. 5, the lower end of the edge wall 104 comes into contact with the base end surface 251, and a downward movement in FIG. 5 is restricted. Then, the tip end of the pin 250 comes into contact with the fusible toy bead 5 placed on the first direction side of the through hole 150, and the fusible toy bead 5 is pushed up relative to the upper opening edge of the through hole 150. The fusible toy bead 5 is separated from the corner portion 163 and the like of the supported columnar portion 160 and the like, and is no longer supported by the through hole 150.

At this time, the plurality of fusible toy beads 5 are connected to such an extent that they can be held by hand. Therefore, the plurality of fusible bead toys 5, which are no longer supported by the through holes 150 and are supported by the tip ends of the pins 250, are lifted by hand and removed from the creation table 10, and an assembly of the fusible toy beads 5 is completed.

Then, by moving the first table 100 upward from the state shown in FIG. 5 to separate the first table 100 and the second table 200 from each other, and returning to the position of FIG. 4 at which the guide hole 120 passes over the engagement protrusion 221, it is possible to make an assembly of the next fusible toy beads 5. In this manner, may assemblies of the fusible toy beads 5 can be made in a short time.

According to the embodiment of the present disclosure described above, it is possible to provide a creation table for fusible toy bead of the following aspects.

A creation table for fusible toy bead according to a first aspect includes: a first table having a plurality of through holes, the first table being configured to allow a fusible toy bead to be placed on a first direction side of the plurality of through holes; and a second table including a plurality of pins, the plurality of pins being allowed to be inserted into and removed from a second direction side of the plurality of through holes, respectively, the second direction side being opposite to the first direction side.

According to this configuration, the first table and the second table can be arranged to overlap with each other, so that it is possible to provide a creation table for fusible toy bead which can be used even in a narrow space and from which an assembly of fusible toy beads can be easily removed.

The creation table for fusible toy bead according to a second aspect further includes a guide part configured to guide the first table and the second table such that the first table and the second table are allowed to approach and separate from each other.

According to this configuration, the first table and the second table can be stably brought close to or separated from each other, so that an assembly of the fusible toy beads can be easily removed from the creation table for fusible toy bead.

In the creation table for fusible toy bead according to a third aspect, the guide part includes: a guide hole provided in the first table; and a guide plate spring provided in the second table, the guide plate spring including an engagement protrusion configured to be engaged with an edge portion of the guide hole when inserted into the guide hole.

According to this configuration, the first table can be held in a state where the pins of the second table are not inserted into the through holes of the first table, and the fusible toy beads can be easily placed on the first table.

In the creation table for fusible toy bead according to a fourth aspect, the second table has a wall portion, the wall portion being positioned on an outer periphery of the first table when the plurality of pins are inserted into the plurality of through holes, and the wall portion includes a regulating plate spring, the regulating plate spring including a regulating protrusion, the regulating protrusion being configured to come into contact with a step portion provided on an outer peripheral edge portion of the first table when the plurality of pins are inserted into the plurality of through holes.

According to this configuration, the first table and the second table can be handled integrally without being easily separated.

In the creation table for fusible toy bead according to a fifth aspect, each of the plurality of through holes includes: an inner peripheral surface; a plurality of columnar portions provided on the first direction side of the through hole, each of the columnar portions including a surface continuous with the inner peripheral surface; and a groove portion formed between adjacent columnar portions of the plurality of columnar portions.

According to this configuration, even if water is sprayed onto the upper surface of the first table on which the fusible toy beads are placed, excess water can be drained into the through holes through the groove portion, and the support of the fusible toy beads by the first table can be made in an intermittent ring shape, so that the fusible toy beads can be prevented from sticking to the edge of the through hole more than necessary.

Although the embodiment of the present disclosure have been described above, the present disclosure is not limited to the above embodiment, and various modifications can be made without departing from the gist thereof. For example, the pin 250 that is removably inserted into the through holes 150 does not need to completely come out of the through hole 150 when the fusible toy bead 5 is placed, and it is sufficient that the pin 250 is at least spaced apart from the fusible toy bead 5 and the fusible toy bead 5 is supported at the edge portion of the through hole 150. The pin 250 may be configured such that, even when the pin 250 is inserted into the through hole 150, the pin 250 is inserted into the through hole 150 to such an extent that the fusible toy bead 5 is separated from the edge portion of the through hole 150.

What is claimed is:

1. A creation table for fusible toy bead, comprising:

a first table having a plurality of through holes, the first table being configured to allow a fusible toy bead to be placed on a first direction side of the plurality of through holes, the first table including an edge wall having a wall shape and extends downward from a lower surface of the first table;

a second table comprising a table base plate and a plurality of pins, the plurality of pins being allowed to be inserted into and removed from a second direction side of the plurality of through holes, respectively, the second direction side being opposite to the first direction side; and a guide part configured to guide the first table and the second table such that the first table and the second table are allowed to approach and separate from each other, wherein the guide part comprises:

a guide hole provided in the first table; and a guide plate spring provided in the second table, the guide plate spring comprising an engagement protrusion configured to be engaged with an edge portion of the guide hole when inserted into the guide hole, wherein the creation table is arranged such that in a first state the first table is maintained spaced apart from the second table such that the plurality of pins are removed from the plurality of through holes, wherein in the first state, edge portions of the engagement protrusion and the guide hole contact with each other so that the first table and the second table are maintained spaced apart, wherein in a second state the first table approaches the second table such that the plurality of pins are inserted into the plurality of through holes, and wherein in the second state, the guide hole is passed over the engagement protrusion and a lower end of the edge wall is in contact with a base end surface of the table base plate.

2. The creation table for fusible toy bead according to claim 1, wherein the second table comprises a wall portion, the wall portion being positioned on an outer periphery of the first table when the plurality of pins are inserted into the plurality of through holes, and wherein the wall portion comprises a regulating plate spring, the regulating plate spring comprising a regulating protrusion, the regulating protrusion being configured to come into contact with a step portion provided on an outer peripheral edge portion of the first table when the plurality of pins are inserted into the plurality of through holes.

3. The creation table for fusible toy bead according to claim 1, wherein each of the plurality of through holes comprises:

an inner peripheral surface;

a plurality of columnar portions provided on the first direction side of the through hole, each of the columnar portions comprising a surface continuous with the inner peripheral surface; and a groove portion formed between adjacent columnar portions of the plurality of columnar portions.

* * * * *